US005208567A

United States Patent [19]

Bell et al.

[11] Patent Number: 5,208,567

[45] Date of Patent: May 4, 1993

[54] TEMPERATURE COMPENSATED DIELECTRIC RESONANT OSCILLATOR

[75] Inventors: Robin A. Bell; Alistair M. Bullen; Ian R. Aldred, all of Hertfordshire, England

[73] Assignee: GEC-Marconi Limited, United Kingdom

[21] Appl. No.: 639,281

[22] Filed: Jan. 10, 1991

[30] Foreign Application Priority Data

Jan. 31, 1990 [GB] United Kingdom ..... 9002120

[51] Int. Cl.[5] ..... H01P 7/10

[52] U.S. Cl. ..... 333/219.1; 333/234

[58] Field of Search ..... 333/202, 219.1, 219, 333/234, 235; 331/96, 107 DP, 117 D

[56] References Cited

U.S. PATENT DOCUMENTS 4,580,116 4/1986 Ballato ..... 333/234
4,835,498 5/1989 Rouger et al. ..... 333/219.1 X

FOREIGN PATENT DOCUMENTS 0006501 1/1987 Japan ..... 333/202
0160802 7/1987 Japan ..... 333/234
2141880 1/1985 United Kingdom .
2188789 10/1987 United Kingdom .
2201045 8/1988 United Kingdom .

*Primary Examiner*—Robert J. Pascal
*Assistant Examiner*—Seung Ham
*Attorney, Agent, or Firm*—Kirschstein, Ottinger, Israel & Schiffmiller

[57] ABSTRACT

A dielectric resonant oscillator for use in frequency conversion of X-band signals comprises a dielectric 'puck' (1) of high dielectric constant mounted on a printed circuit board (3) adjacent a stripline conductor (5). The puck (1) forms a resonant cavity to signals in the stripline and the system oscillates typically at X-band. The puck (1) has an inherent temperature compensating dielectric/temperature characteristic which generally compensates temperature dependent circuit characteristics. However the substrate (3) dielectric/-temperature characteristic (FIG. 1 ) upsets the balance, the substrate (3) being coupled to the cavity by the electric field. The balance is regained by introducing a metallic pad (7) under the puck of (1) half the puck diameter thus bringing the temperature driven variation to 1.25 ppm. A further development provides two or more radial extensions (9) of the pad (7) which shift unwanted hybrid modes away from the wanted TEM mode and prevent mode jumping and consequent instability.

16 Claims, 3 Drawing Sheets

TEMPERATURE COMPENSATED DIELECTRIC RESONANT OSCILLATOR

BACKGROUND OF THE INVENTION

This invention relates to dielectric resonant oscillators, that is, to oscillators of the kind comprising a signal path coupled electromagnetically to an adjacent resonant cavity constituted by a body of dielectric material. The dielectric body, herein referred to as a "puck" has dimensions and a dielectric constant which together determine the resonant frequency (or frequencies) of the 'cavity' and thus the oscillation frequency. The dielectric puck may be mounted on a printed circuit board by adhesion to the substrate, closely adjacent to a stripline conductor constituting the above signal path.

A typical operating frequency for such an oscillator would be 10 GHz and a typical application would be as a local oscillator in a receiver of a satellite transmission. The X-band transmission is thus converted to a relatively low intermediate frequency of, say, 1-2 GHz. The converter circuitry is commonly formed on printed circuit board employing stripline conductors and both 'printed' and discrete components. While the term "printed circuit" is used in this specification for convenience, it will be appreciated that the actual method of forming stripline conductors and like circuitry is not directly relevant to the invention and the term is thus to be interpreted broadly.

There are several problems associated with temperature effects on the circuit components. One problem concerns the temperature sensitivity of the physical features of the circuitry e.g. screw expansion (where a tuning screw is used), board expansion, board dielectric change, and the consequent change of operating frequency with temperature. This can be largely compensated by a suitable permittivity temperature characteristic of the puck material, of which a range is available. Thus a puck material is available having a 'frequency compensation' characteristic of 9 parts per million/° C., the dielectric constant of the puck material changing with temperature in a direction such as to oppose the effect of circuit temperature on frequency. At a frequency of 10 GHz this would provide compensation of about 7 MHz over a temperature range of −20° C. to +60° C.

However, this compensation facility is modified by the presence of the substrate and its temperature/dielectric constant characteristic. The variation of board dielectric constant $E_r$ with temperature is illustrated, for a PTFE material, in FIG. 1 of the accompanying drawings.

The substrate temperature sensitivity makes its presence felt because the electric field in the puck couples with the substrate so that the puck and substrate tend to form a single resonant entity. The frequency drift is therefore determined partly by the substrate characteristic.

The dielectric constant of the puck is high, e.g. 35, whereas that of the substrate is perhaps 2, for PTFE, up to 10 for alumina. Care must be taken in the choice of substrate material so as not to degrade the circuit Q, high values of which are obtained with ceramic (e.g. alumina) or PTFE based low loss materials.

It has been proposed to mount the puck off the substrate on a ceramic pedestal but this involves complex assembly procedures.

SUMMARY OF THE INVENTION

An object of the invention is to alleviate these problems and provide a high-Q dielectric resonant oscillator which is relatively insensitive to temperature variation and can be mechanically tuned over at least a 10% bandwidth.

According to the present invention, in a dielectric resonant oscillator comprising a body of a first dielectric material mounted on a base of a second dielectric material and having a conductor disposed immediately adjacent to the body and adapted to carry an R.F. signal, the dimensions of the body being such that the body presents a resonant cavity to an R.F. signal of predetermined frequency coupled from the conductor, and wherein a conductive pad is disposed between the body and the base to de-couple the base from the body and make the resonant frequency of the cavity substantially independent of the temperature dependence of the dielectric constant of the base.

The pad preferably has a surface area less than or substantially equal to half the projected area of the body on to the base. The pad may be circular and the body have a flat circular surface in contact with the pad, the pad and body being disposed concentrically. The pad may be formed as part of a printed circuit on a substrate constituting the base, and the body may be adhesively mounted on the pad. The substrate may be PTFE (polytetrafluoroethylene).

The conductor is preferably part of the printed circuit.

The pad may have a diameter approximately half that of the circular surface of the body.

Such an oscillator may exhibit a wanted transverse-electric (TEM) resonant oscillation mode and an unwanted hybrid electro-magnetic (HEM) resonant oscillation mode, the resonant frequencies of the modes being inherently sufficiently close to cause instability, and the pad being so shaped as to displace or suppress the unwanted resonance away from the wanted resonance.

The body may be of cylindrical form having one circular end face adjoining the pad and the pad being of circular form lying within the extent of the body and having diametrically opposite extensions extending to a position just outside the extent of the body. Alternatively, there may be a plurality of such extensions distributed around the circular pad.

The circular part of the pad may have a diameter approximately half that of the body and the extensions may be parallel sided strips having a width of between one-half and one-twelfth of the body diameter without unduly affecting the operation of the TEM mode.

The pad may be in two or more portions separated along radii through the extensions and coupled together by passive devices or by active variable reactance devices adapted to be controlled to tune the oscillation frequency.

BRIEF DESCRIPTION OF THE DRAWINGS

A dielectric resonant oscillator in accordance with the invention will now be described, by way of example, with reference to the accompanying drawings, of which.

DETAILED DESCRIPTION OF THE PREFERRED EMBODIMENTS

Figure 1:
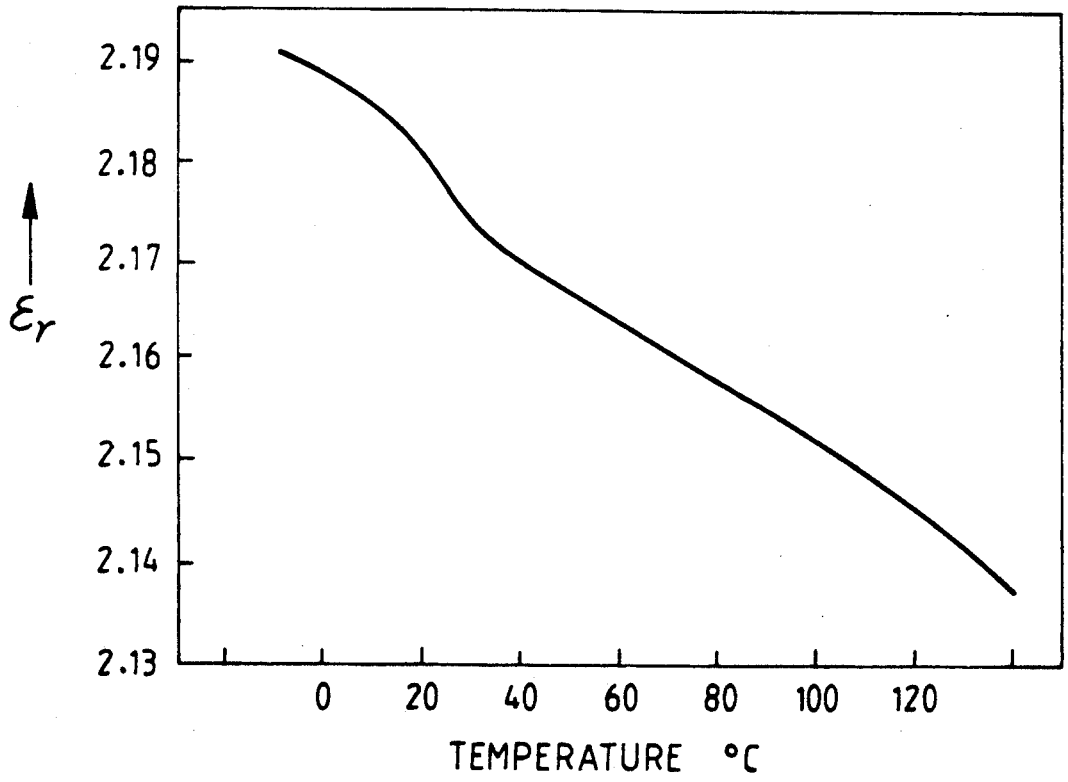
FIG. 1 is a graph of PCB substrate dielectric constant against temperature.

FIG. 1 shows a significant variation of substrate dielectric with temperature, this being a large part of the cause of frequency drifting.

Figure 2:
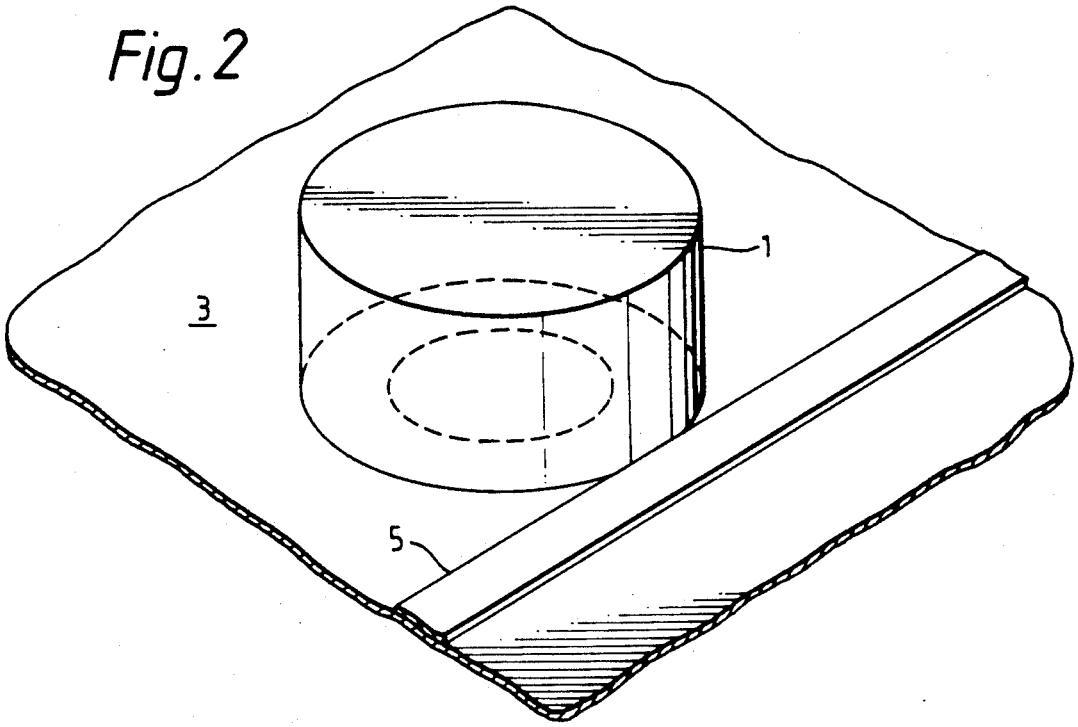
FIG. 2 is a perspective view of a dielectric body, a "puck", mounted on a substrate.

FIG. 2 shows a puck 1 mounted by means of an adhesive directly on to a printed circuit substrate 3 and contiguous with a stripline conductor 5 which is part of the printed circuit. The conductor 5 carries a signal of frequency such as to excite an oscillation in the puck 1 which acts as a resonant cavity. The material of the puck is barium titanate or a derivative thereof and its dimensions are approximately 6 mm diameter by 2.5 mm axial length for operation at 10 GHz. This constitutes a resonant cavity where physical contact between stripline 5 and puck 1 is not required.

As so far described, the puck and stripline provide a so-called dielectric resonant oscillator which suffers from the above described disadvantages. Thus, it exhibits a significant temperature error due to the presence of the substrate, and mode instability when mechanically tuned.

Such mechanical tuning of the resulting oscillator may be achieved by adjusting a screw, which may or may not be grounded, above the upper face of the puck so as to decrease or increase the gap between screw and puck. The resonant frequency is thus moved up or down respectively. It is found that in a significant number of devices of this basic kind, the resonant frequency, that is the wanted resonance in a transverse electric ($TE_{01\delta}$) mode, is suddenly lost and operation jumps to a hybrid electro-magnetic or other mode which tunes in the opposite direction. Instability results if the wanted and the unwanted resonances are so close to each other as to permit operation jumping between them. It is an object of a preferred class of embodiments according to the invention to separate the wanted and the unwanted resonances by displacing the latter. This will be described subsequently with reference to FIGS. 4 and 5.

A further feature of the invention, of practical value in manufacture, concerns a problem in affixing the puck to the substrate. In the case of a PTFE substrate there are very few adhesives which can be used and even then the adhesion is less than perfect. The invention provides a simple solution to this problem.

Figure 3:
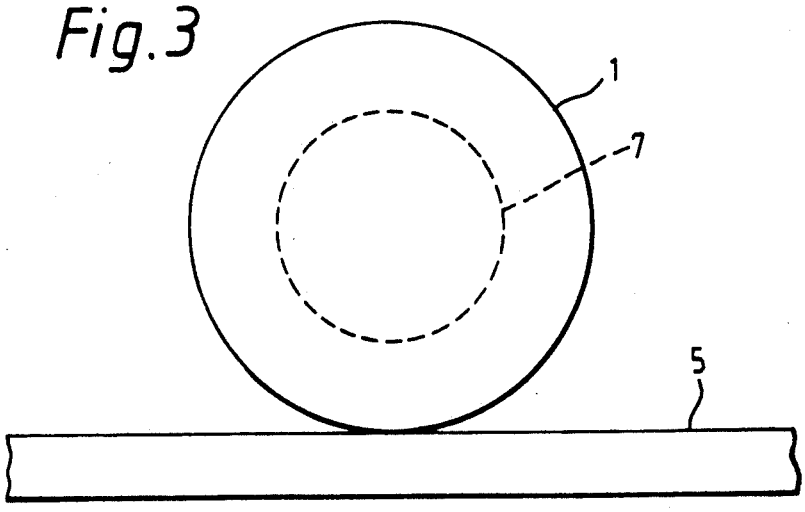
FIG. 3 is a plan view of a puck mounted on a substrate according to the invention.

Reverting to the drawings, FIG. 3 shows a similar arrangement (in plan) to that of FIG. 2 with the addition of a metal pad 7 between the puck 1 and the PTFE substrate 3. The pad 7 is formed as part of the printed circuit by etching in known manner. The pad is thus of the same thickness as the rest of the stripline circuitry, namely about 25 microns. The diameter of the pad is more critical and should preferably be about half of the puck diameter with a limit at which the pad area is substantially equal to half of the projected area of the puck on to the substrate. The electric field in the puck extends downwardly into the substrate (in the absence of the pad) and varies in intensity radially to a peak value at about three-quarters of the puck radius out from the axis. The effect of the conductive pad is to isolate the puck from the substrate by providing a termination for a portion of the electric field without having too detrimental an effect on the oscillator Q value.

The result of this isolation is to limit the overall temperature variation to about 1.25 ppm/° C. which, over a temperature range of −20° C. to +60° C. amounts to only about 1MHz at X-band.

In addition to this solving of the temperature dependency problem the Q value of the resonance is maintained at a high value.

The yet further benefit is derived that adhesion of the puck to the metallic pad is now a simple matter since adhesion between copper and ceramic materials is a far more controllable process than between PTFE and ceramic.

Figure 4:
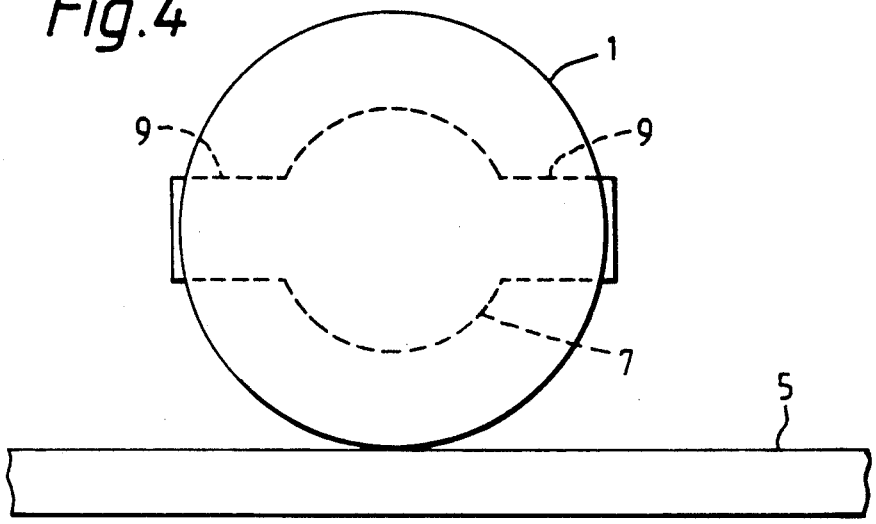
FIG. 4 is a plan view illustrating one modification of the arrangement of FIG. 3.
Figure 5:
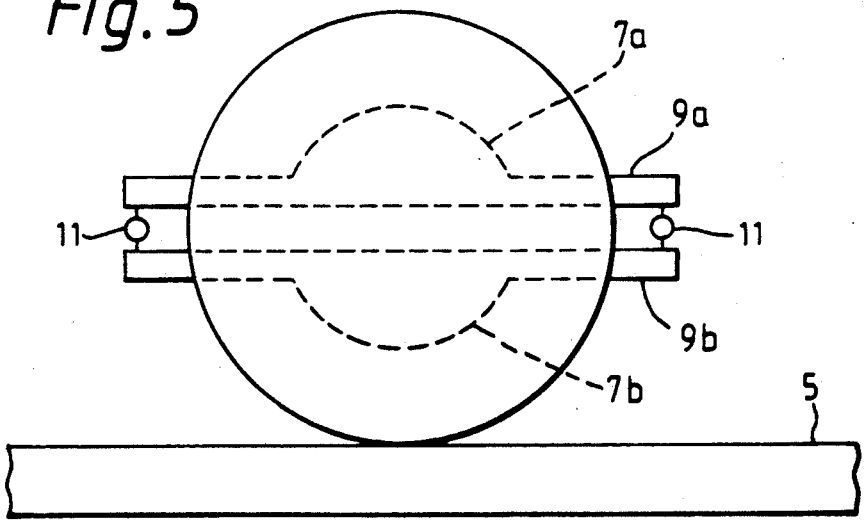
FIG. 5 is a plan view of a further modification of FIG. 3.

Referring now to the problem of operational instability resulting from the presence of, particularly, the $HEM_{12\delta}$ hybrid mode, but including others, FIG. 4 shows a modification of the pad which displaces this and other unwanted resonances downwards in frequency, away from the wanted TEM mode. This shift can be made to exceed 10% of the start frequency and thus render the hybrid mode or modes harmless. The modification consists in providing ear-like diametrically opposite extensions 9 of the pad 7, parallel to the signal path 5. These extensions are parallel strips of width between one-half and one-twelfth of the puck diameter, and extending just beyond the puck. In a variation of the FIG. 4 design, shown in FIG. 5, the 'eared' pad 7 is formed in two portions 7*a* and 7*b*, the two portions so formed being connected together by active devices, variable reactances, 11. The puck can thereby be tuned to provide optimum shift of the unwanted hybrid mode and fine control of the wanted resonance or to enable wideband tuning of hybrid modes for certain system configurations requiring stable oscillators with up to 1% electronic tuning.

In a further modification of the FIG. 4 design, the extensions of the central pad area are three or more in number, the third (if three) extension forming a T with the diametrically opposite pair. This third extension provides displacement or suppression of one or more other hybrid modes from the wanted mode, and in the same direction on tuning.

Further extensions may be provided to deal with other modes although a fourth extension completing the cross might cause difficulties with proximity to the stripline.

In a yet further modification of the oscillator a metallic pad may be affixed to the upper surface (i.e. remote from the substrate) of the puck to displace, suppress or modify one or more predetermined operational modes. Several such supplementary pads may be used on the top and/or curved surface of the puck in respect of one or more predetermined operational modes.

We claim:

1. A dielectric resonant oscillator, comprising:

a body of a first dielectric material;

a base of a second dielectric material having a temperature-dependent dielectric constant, said body being mounted on said base;

a conductor disposed on said base immediately adjacent to said body for carrying a radio frequency signal;

said body having dimensions causing said body to present a cavity having a resonant frequency to a radio frequency signal coupled from said conductor; and a conductive pad disposed between said body and said base, said body having a projected area on said base, and said pad having a surface area less than, or substantially equal to, half said projected area, said pad being effective to de-couple said base from said body and cause said resonant frequency of said cavity to be independent of the temperature dependence of said temperature-dependent dielectric constant.

2. An oscillator according to claim 1, exhibiting a wanted transverse-electric resonant oscillation mode and an unwanted hybrid electro-magnetic resonant oscillation mode, each said mode exhibiting a resonance at a respective frequency, the resonant frequencies of the two modes being inherently sufficiently close to cause instability, wherein said pad is shaped to displace the unwanted resonance away from the wanted resonance.

3. An oscillator according to claim 1, wherein said pad is circular and said body has a flat circular surface in contact with the pad, said pad and said body being disposed concentrically.

4. An oscillator according to claim 3, wherein said pad is formed as part of a printed circuit on a substrate constituting said base, and said body is adhesively mounted on the pad.

5. An oscillator according to claim 4, wherein said substrate is polytetrafluoroethylene.

6. An oscillator according to claim 4, wherein said conductor is part of said printed circuit.

7. An oscillator according to any of claim 3, wherein said pad has a diameter approximately half that of said surface of the body.

8. An oscillator according to claim 2, wherein said pad comprises a plurality portions capacitively coupled together.

9. An oscillator according to claim 2, wherein said body is of cylindrical form having circular end faces, each of said end faces having an end face diameter, said pad comprising a circular disc and a plurality of printed circuit stripline extensions from said circular disc.

10. An oscillator according to claim 9, wherein said circular disc has a diameter approximately half said end face diameter and said extensions are parallel sided strips having a width within a range one-half to one-twelfth of said end face diameter.

11. An oscillator according to claim 9, comprising at least three said extensions for suppressing hybrid modes.

12. An oscillator according to claim 10, wherein there are two said extensions lying diametrically opposite each other.

13. An oscillator according to claim 12, wherein said pad comprises two portions spaced apart by a region of said base, said region lying centrally along said extensions and dividing said circular disc and each of said extensions into equal portions, said oscillator further comprising a passive device in respect of each of said extensions, said passive device coupling together said equal portions of the respective extension.

14. An oscillator according to claim 12, wherein said pad comprises two portions spaced apart by a region of said base, said region lying centrally along said extensions and dividing said circular disc and each of said extensions into equal portions, said oscillator further comprising an active device in respect of each of said extensions, said active device coupling together said equal portions of the respective extension.

15. An oscillator according to claim 12, wherein said extensions of the pad extend in a direction parallel to said conductor feeding the resonant cavity of said body.

16. A dielectric resonant oscillator, comprising:

a body of a first dielectric material;

a base of a second dielectric material having a temperature-dependent dielectric constant, said body being mounted on said base, said base constituting a substrate for a printed circuit;

said printed circuit including a conductor disposed on said base immediately adjacent to said body for carrying a radio frequency signal;

said body having dimensions causing said body to present a cavity having a resonant frequency to a radio frequency signal coupled from said conductor; and a conductive pad mounted directly on said base between said body and said base, said pad being an isolated part of said printed circuit effective to de-couple said base from said body and cause said resonant frequency of said cavity to be independent of the temperature dependence of said temperature-dependent dielectric constant.

* * * * *